United States Patent [19]

Holowaty et al.

[11] 4,244,737

[45] Jan. 13, 1981

[54] METHOD AND ALLOY FOR INTRODUCING MACHINABILITY INCREASING INGREDIENTS TO STEEL

[75] Inventors: Michael O. Holowaty, Crown Point, Ind.; Debanshu Bhattacharya, Matteson, Ill.

[73] Assignee: Inland Steel Company, Chicago, Ill.

[21] Appl. No.: 70,670

[22] Filed: Aug. 29, 1979

[51] Int. Cl.[3] ..... C22C 33/00

[52] U.S. Cl. ..... 75/129; 75/58; 75/134 B; 75/166 R; 75/166 B

[58] Field of Search ..... 75/166 R, 58, 166 B, 75/129, 134 B

[56] References Cited

U.S. PATENT DOCUMENTS

| | | | |
|---|---|---|---|
| 1,584,922 | 5/1926 | Geppert | 75/166 B |
| 3,301,642 | 1/1967 | Youssef | 75/166 R |
| 3,784,374 | 1/1974 | Almand | 75/58 |
| 3,933,480 | 1/1976 | Tipnis | 75/58 |

*Primary Examiner*—P. D. Rosenberg

*Attorney, Agent, or Firm*—Merriam, Marshall & Bicknell

[57] ABSTRACT

Lead, bismuth and tellurium and/or sulfur are added to steel, to increase the machinability of the steel, in an addition alloy consisting essentially of 5–40 parts lead, 5–40 parts bismuth, up to 6 parts tellurium and up to 25 parts sulfur. The alloy contains at least one of the group tellurium and sulfur, and the alloy has a melting point of at least about 400° C. (752° F.).

11 Claims, No Drawings

METHOD AND ALLOY FOR INTRODUCING MACHINABILITY INCREASING INGREDIENTS TO STEEL

BACKGROUND OF THE INVENTION

The present invention relates generally to methods and alloys for adding to steel machinability increasing ingredients and more particularly to a method or alloy for adding lead and bismuth to steel.

Lead and bismuth enhance the machinability of steel. It is desirable to add lead and bismuth to steel together, e.g. as a lead-bismuth alloy, because this improves the uniformity with which the lead and bismuth are distributed in the steel.

Both lead and bismuth have relatively low melting points, lead having a melting point of 327° C. (621° F.) and bismuth having a melting point of 271° C. (520° F.). When lead and bismuth are combined together in an alloy of the two, the resulting alloy has a melting point even lower than that of its constituents. For example, a lead bismuth eutectic (55.5% bismuth and the balance lead) has a melting point of about 125° C. (257° F.). Because a lead-bismuth alloy has such a low melting point, problems will arise when this alloy has been introduced into steel. For example, because of the low melting point, the lead-bismuth alloy may separate to the bottom of an ingot mold into which molten steel containing the lead-bismuth alloy has been poured for casting into an ingot. Moreover, during hot rolling of the steel, the lead bismuth alloy may be squeezed out of the steel shape undergoing hot rolling.

SUMMARY OF THE INVENTION

In accordance with the present invention, lead and bismuth are added to the steel as an alloy which also contains an addition which substantially increases the melting point of the alloy while contributing to the machinability of the steel. This addition is selected from the group consisting of tellurium, sulfur, or combinations thereof. A sufficient amount of tellurium and/or sulfur is added to the alloy to provide the alloy with a melting point of at least 400° C. (752° F.). Preferably, the alloy consists essentially of 5–40 parts of lead, 5–40 parts of bismuth, up to 6 parts of tellurium and up to 25 parts of sulfur, the alloy containing at least one of the group tellurium and sulfur.

The alloy may be added to molten steel when the latter is being cast into a solid shape. Thus the alloy may be introduced into the molten steel in an ingot mold or in the tundish of a continuous casting apparatus. The alloy is introduced in particulate form having a size finer than ten mesh.

Other features and advantages are inherent in the method and alloy claimed and disclosed or will become apparent to those skilled in the art from the following detailed description.

DETAILED DESCRIPTION

A steel comprising lead, bismuth and tellurium and/or sulfur to improve the machinability of the steel generally includes these elements in the weight percentages set forth below:

| | |
|---|---|
| lead | 0.05–0.40 |
| bismuth | 0.05–0.40 |
| tellurium | up to 0.06 |
| sulfur | up to 0.40 |

When lead, bismuth, tellurium and sulfur are added to steel, part of each of these ingredients is lost during the addition procedure so that the amount recovered in the steel is less than the amount added to the steel. The loss of lead, bismuth and tellurium is due primarily to vaporization, and each of these three elements vaporizes at about the same rate, so that the recovery of each in the solidified steel will be about the same, expressed as a percent of the element added to the steel in the beginning. To make up for the loss of each of these elements during the addition procedure, one need merely add more of the alloy containing these three ingredients.

The amount of sulfur lost during addition to the steel is less than that of the other three elements. Therefore, if sulfur were present in the addition alloy in the same ratio to the other elements as the desired ratio of sulfur to these elements in the final steel composition, the amount of sulfur ending up in the steel would be higher than the amount of sulfur in the alloy. Therefore, the ratio of sulfur to the other three ingredients should be less in the alloy than is desired in the steel, but the ratio of lead, bismuth and tellurium to each other may be about the same in the alloy as is desired in the steel.

Accordingly, in an alloy in accordance with the present invention, the relative amounts of the four elements is as set forth below, expressed in parts (the weight percentages of these four elements in the steel is set forth alongside, for comparison purposes):

| | Parts in Alloy | Wt. % in Steel |
|---|---|---|
| lead | 5–40 | 0.05–0.40 |
| bismuth | 5–40 | 0.05–0.40 |
| tellurium | up to 6 | up to 0.06 |
| sulfur | up to 25 | up to 0.40 |

As noted above, there is always at least one of the group sulfur and tellurium present in the alloy. When tellurium is present in steel in machinability increasing amounts, there is at least 0.015 wt.% tellurium, and this corresponds to 1.5 parts of tellurium in the alloy. When sulfur is present in steel in machinability increasing amounts, there is at least 0.03 wt.% sulfur, and this corresponds to about 1.9 parts sulfur in the alloy. To obtain a tellurium content of 0.03 wt.% in the steel would require about 3 parts of tellurium in the same alloy. Fewer parts of sulfur (1.9 parts) are required in the alloy than parts of tellurium (3 parts) to obtain a sulfur content in the steel which is the same as the tellurium content (e.g., 0.03 wt.%) because more sulfur than tellurium is recovered from the alloy.

Examples of alloys having compositions, expressed in both wt.% and parts, in accordance with the present invention are set forth below in Table I.

TABLE I

| | | Lead | Bismuth | Tellurium | Sulfur |
|---|---|---|---|---|---|
| A | Wt. % | 47 | 47 | 6 | — |
| | parts | 23 | 23 | 3 | |
| B | Wt. % | 32 | 62 | 6 | — |
| | parts | 16 | 31 | 3 | — |
| C | Wt. % | 29 | 58 | 13 | — |
| | parts | 15 | 29 | 7 | — |
| D | Wt. % | 38 | 43 | — | 18 |
| | parts | 35 | 40 | — | 16 |
| E | Wt. % | 23 | 62 | — | 16 |

TABLE I-continued

| | | Lead | Bismuth | Tellurium | Sulfur |
|---|---|---|---|---|---|
| | parts | 11 | 29 | — | 7 |
| F | Wt. % | 25 | 45 | 10 | 20 |
| | parts | 22 | 40 | 9 | 18 |
| G | Wt. % | 34 | 40 | 12 | 14 |
| | parts | 31 | 36 | 11 | 13 |

Each of the examples A-G has a melting point of at least about 400° C. (752° F.). For example compositions A and B have respective melting points of about 500° C. (932° F.), and composition C has a melting point of about 600° C. (1112° F.). There is essentially no maximum limit on the melting point of the alloy although, as a practical matter, it would never exceed the melting point of steel (e.g., about 1500° C.) (2732° F.).

The alloy should be added to the molten steel in particulate form which may be either shot or particles crushed from cast blocks of the alloy. In whatever particulate form the alloy is added, it should have a size finer than about 10 mesh, preferably in the range 20–40 mesh with no greater than 5% minus 100 mesh.

The alloy may be introduced either into an ingot mold or into the tundish of a continuous casting apparatus. When the alloy is introduced into an ingot mold, introduction takes place when the mold is between $\frac{1}{8}$ and $\frac{7}{8}$ full (ingot height). In one embodiment, the alloy is added to the stream of molten steel entering the ingot mold at a location on the steam about 6 inches to 2 feet above the top of the ingot mold. In another embodiment, the alloy is added at substantially the location of impact, in the partially filled ingot mold, of the molten metal stream. When the alloy is added as shot, use may be made of a conventional shot-adding gun, heretofore utilized for adding to steel other ingredients in shot form (e.g., elemental lead).

When added to the tundish of a continuous casting apparatus, the alloy may be added as loose shot or in 5 pound bags. Preferably, the alloy is added to the tundish with a shot-adding gun. The alloy may also be added to the molten metal stream entering the continuous casting mold at a location typically about 1 to $1\frac{1}{2}$ feet above the location of impact of the stream in the mold.

The temperature of the molten steel when the alloy is added thereto should be in the range of about 1550°–1600° C. (2822°–2912° F.).

The uniformity of distribution of inclusions formed by the alloy may be enhanced by stirring the molten steel, either in the ingot mold or in the tundish, after the alloy has been added. Stirring may be accomplished mechanically, electromagnetically, by convection currents or with currents caused by the presence, in the molten steel, of greater than 100 parts per million of oxygen which, during cooling of the molten steel, will attempt to escape from, and thereby create currents in, the molten steel.

The foregoing detailed description has been given for clearness of understanding only, and no unnecessary limitations should be understood therefrom, as modifications will be obvious to those skilled in the art.

We claim:

1. A method for introducing lead and bismuth to steel, said method comprising the steps of:

adding to molten steel an alloy of 5–40 parts lead and 5–40 parts bismuth, said alloy being added as discrete particles thereof to enhance the uniformity of distribution in said molten steel of said lead and bismuth; and including, as an addition in said alloy of lead and bismuth, at least one of 1.5–6 parts tellurium and 1.9–25 parts sulfur;

said addition being present in an amount which substantially increases the melting point of said alloy while contributing to the machinability of the steel, whereby the amount of lead and bismuth retained in the steel is substantially increased.

2. In a method as recited in claim 1 wherein:

said alloy with said addition is in particulate form having a size finer than 10 mesh.

3. In a method as recited in claim 1 wherein:

said molten steel is cast in an ingot mold into which a stream of said molten steel is directed;

and said alloy with said addition is added to said molten steel when said mold is between one-eighth and seven-eighths full of molten steel.

4. In a method as recited in claim 3 wherein:

said alloy with said addition is in particulate form and is added at substantially the location of impact, in the partially filled ingot mold, of said molten steel stream.

5. In a method as recited in claim 3 wherein:

said alloy with said addition is in particulate form and is added to said stream at a location on the stream slightly above the location of impact of said stream in the partially filled ingot mold.

6. In a method as recited in claim 1 wherein:

said molten steel is continuously cast using a continuous casting apparatus having a tundish;

and said alloy with said addition is added to said molten steel in particulate form at said tundish.

7. In a method as recited in claim 1 wherein:

there is a sufficient amount of said addition in said alloy to provide the alloy with a melting point of at least about 400° C. (752° F.).

8. In a method as recited in claim 1 wherein:

the ratio of sulfur to bismuth in said alloy is less than the ratio of sulfur to bismuth desired in said steel.

9. An alloy for introducing machinability increasing ingredients into steel, said alloy consisting essentially of, in parts:

lead: 5–40 bismuth: 5–40 and at least one of 1.5–6 parts tellurium and 1.9–25 parts sulfur.

10. An alloy as recited in claim 9 wherein:

said alloy includes a sufficient amount of tellurium and/or sulfur to provide said alloy with a melting point of at least about 400° C. (752° F.).

11. An alloy as recited in claim 9 wherein:

said alloy is in particulate form having a size finer than 10 mesh.

* * * * *